US009565493B2

(12) United States Patent
Abraham et al.

(10) Patent No.: US 9,565,493 B2
(45) Date of Patent: Feb. 7, 2017

(54) ARRAY MICROPHONE SYSTEM AND METHOD OF ASSEMBLING THE SAME

(71) Applicant: Shure Acquisition Holdings, Inc., Niles, IL (US)

(72) Inventors: Mathew T. Abraham, Morton Grove, IL (US); David Grant Cason, Palatine, IL (US); John Casey Gibbs, Chicago, IL (US); Gregory William Lantz, Aurora, IL (US); Albert Francis McGovern, Jr., Naperville, IL (US); Brent Robert Shumard, Mount Prospect, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 0 days.

(21) Appl. No.: 14/701,376

(22) Filed: Apr. 30, 2015

(65) Prior Publication Data

US 2016/0323668 A1 Nov. 3, 2016

(51) Int. Cl.
*H04R 1/40* (2006.01)
*H04R 31/00* (2006.01)

(52) U.S. Cl.
CPC ..... *H04R 1/406* (2013.01); *H04R 31/00* (2013.01); *H04R 2201/021* (2013.01); *H04R 2201/40* (2013.01)

(58) Field of Classification Search
CPC ..... H04R 1/406
(Continued)

(56) References Cited

U.S. PATENT DOCUMENTS 5,870,482 A * 2/1999 Loeppert ..... B81B 3/0072 381/174
5,888,412 A * 3/1999 Sooriakumar ..... G01L 9/0042 216/2

(Continued)

FOREIGN PATENT DOCUMENTS

CA 2838856 12/2012
CA 2846323 9/2014

(Continued)

OTHER PUBLICATIONS

International Search Report and Written Opinion for PCT/US2016/029751 dated Nov. 28, 2016 (21 pp.).

(Continued)

*Primary Examiner* — Gerald Gauthier
(74) *Attorney, Agent, or Firm* — William J. Lenz, Esq.; Neal, Gerber & Eisenberg LLP

(57) ABSTRACT

Embodiments include a microphone assembly comprising an array microphone and a housing configured to support the array microphone and sized and shaped to be mountable in a drop ceiling in place of at least one of a plurality of ceiling tiles included in the drop ceiling. A front face of the housing includes a sound-permeable screen having a size and shape that is substantially similar to the at least one of the plurality of ceiling tiles. Embodiments also include an array microphone system comprising a plurality of microphones arranged, on a substrate, in a number of concentric, nested rings of varying sizes around a central point of the substrate. Each ring comprises a subset of the plurality of microphones positioned at predetermined intervals along a circumference of the ring.

40 Claims, 11 Drawing Sheets

(58) Field of Classification Search
USPC ..... 257/415, 416; 356/505; 381/91, 92, 111, 381/174, 355; 455/41.1; 29/594; 216/41; 310/309; 340/870.02; 347/170
See application file for complete search history.

(56) References Cited

U.S. PATENT DOCUMENTS

| | | | | |
|---|---|---|---|---|
| 6,205,224 | B1 | 3/2001 | Underbrink | |
| 6,488,367 | B1 * | 12/2002 | Debesis | B41J 2/1607 347/70 |
| 7,536,769 | B2 * | 5/2009 | Pedersen | B81B 3/0072 156/89.11 |
| 7,701,110 | B2 * | 4/2010 | Fukuda | B06B 1/0292 310/309 |
| 8,213,634 | B1 | 7/2012 | Daniel | |
| 8,286,749 | B2 | 10/2012 | Stewart, Jr. et al. | |
| 8,297,402 | B2 | 10/2012 | Stewart et al. | |
| 8,403,107 | B2 | 3/2013 | Stewart, Jr. et al. | |
| 8,479,871 | B2 | 7/2013 | Stewart et al. | |
| 8,631,897 | B2 | 1/2014 | Stewart, Jr. et al. | |
| 8,672,087 | B2 | 3/2014 | Stewart, Jr. et al. | |
| 9,126,827 | B2 * | 9/2015 | Hsieh | B81B 3/00 |
| 9,226,088 | B2 | 12/2015 | Pandey et al. | |
| 9,319,799 | B2 * | 4/2016 | Salmon | H04R 19/04 |
| 9,403,670 | B2 * | 8/2016 | Schelling | B81B 3/0059 |
| 2002/0149070 | A1 * | 10/2002 | Sheplak | G01H 11/08 257/415 |
| 2003/0063762 | A1 * | 4/2003 | Tajima | H04R 19/005 381/111 |
| 2006/0192976 | A1 * | 8/2006 | Hall | G01D 5/266 356/505 |
| 2007/0120029 | A1 | 5/2007 | Keung et al. | |
| 2010/0314513 | A1 | 12/2010 | Evans et al. | |
| 2011/0007921 | A1 | 1/2011 | Stewart, Jr. et al. | |
| 2011/0311085 | A1 | 12/2011 | Stewart, Jr. et al. | |
| 2012/0002835 | A1 | 1/2012 | Stewart, Jr. et al. | |
| 2012/0080260 | A1 | 4/2012 | Stewart, Jr. et al. | |
| 2012/0177219 | A1 * | 7/2012 | Mullen | F41G 3/147 381/92 |
| 2012/0294472 | A1 | 11/2012 | Hudson et al. | |
| 2013/0004013 | A1 | 1/2013 | Stewart, Jr. et al. | |
| 2013/0015014 | A1 | 1/2013 | Stewart et al. | |
| 2013/0039504 | A1 | 2/2013 | Pandey et al. | |
| 2013/0094689 | A1 * | 4/2013 | Tanaka | H04R 19/005 381/355 |
| 2013/0101141 | A1 | 4/2013 | McElveen | |
| 2013/0251181 | A1 | 9/2013 | Stewart, Jr. et al. | |
| 2013/0264144 | A1 | 10/2013 | Hudson et al. | |
| 2013/0336516 | A1 | 12/2013 | Stewart et al. | |
| 2014/0072151 | A1 * | 3/2014 | Ochs | H04R 23/00 381/174 |
| 2014/0264654 | A1 * | 9/2014 | Salmon | H04R 19/04 257/416 |
| 2014/0265774 | A1 | 9/2014 | Stewart, Jr. et al. | |
| 2014/0270271 | A1 * | 9/2014 | Dehe | B81B 3/0018 381/174 |
| 2014/0286518 | A1 | 9/2014 | Stewart, Jr. et al. | |
| 2014/0301586 | A1 | 10/2014 | Stewart, Jr. et al. | |
| 2014/0357177 | A1 | 12/2014 | Stewart, Jr. et al. | |
| 2015/0070188 | A1 * | 3/2015 | Aramburu | A01G 25/167 340/870.02 |
| 2015/0078582 | A1 * | 3/2015 | Graham | H04R 1/08 381/92 |
| 2015/0118960 | A1 * | 4/2015 | Petit | H04W 4/008 455/41.1 |
| 2016/0031700 | A1 * | 2/2016 | Sparks | B81B 3/007 381/91 |

FOREIGN PATENT DOCUMENTS

| | | |
|---|---|---|
| CN | 102833664 | 12/2012 |
| CN | 104080289 | 10/2014 |
| EP | 2721837 | 4/2014 |
| EP | 2778310 | 9/2014 |
| WO | WO2010144148 | 12/2010 |
| WO | WO2012174159 | 12/2012 |

OTHER PUBLICATIONS

Arnold, et al. "A directional acoustic array using silicon micromachined piezoresistive microphones," Journal of Acoustical Society of America, 113 (1), pp. 289-298, Jan. 2003 (10 pp.).
Chou, "Frequency-Independent Beamformer with Low Response Error," 1995 International Conference on Acoustics, Speech, and Signal Processing, pp. 2995-2998, May 9, 1995 (4 pp.).

* cited by examiner

ARRAY MICROPHONE SYSTEM AND METHOD OF ASSEMBLING THE SAME

TECHNICAL FIELD

This application generally relates to an array microphone system and method of assembling the same. In particular, this application relates to an array microphone capable of fitting into a ceiling tile of a drop ceiling and providing 360-degree audio pickup with an overall directivity index that is optimized across the voice frequency range.

BACKGROUND

Conferencing environments, such as boardrooms, video conferencing settings, and the like, can involve the use of microphones for capturing sound from audio sources. The audio sources may include human speakers, for example. The captured sound may be disseminated to an audience through speakers in the environment, a telecast, and/or a webcast.

In some environments, the microphones may be placed on a table or lectern near the audio source in order to capture the sound. However, such microphones may be obtrusive or undesirable, due to their size and/or the aesthetics of the environment in which the microphones are being used. In addition, microphones placed on a table can detect undesirable noise, such as pen tapping or paper shuffling. Microphones placed on a table may also be covered or obstructed, such as by paper, cloth, or napkins, so that the sound is not properly or optimally captured.

In other environments, the microphones may include shotgun microphones that are primarily sensitive to sounds in one direction. The shotgun microphones can be located farther away from an audio source and be directed to detect the sound from a particular audio source by pointing the microphone at the area occupied by the audio source. However, it can be difficult and tedious to determine the direction to point a shotgun microphone to optimally detect the sound coming from its audio source. Trial and error may be needed to adjust the position of the shotgun microphone for optimal detection of sound from an audio source. As such, the sound from the audio source may not be ideally detected unless and until the position of the microphone is properly adjusted. And even then, audio detection may be less than optimal if the audio source moves in and out of a pickup range of the microphone (e.g., if the human speaker shifts in his/her seat while speaking).

In some environments, microphones may be mounted to a ceiling or wall of the conference room to free up table space and provide human speakers with the freedom to move around the room, thereby resolving at least some of the above concerns with tabletop and shotgun microphones. Most existing ceiling-mount microphones are configured to be secured directly to the ceiling or hanging from drop-down cables that are mounted to the ceiling. As a result, these products require complex installation and tend to become a permanent fixture. Further, while ceiling microphones may not pick up tabletop noises given their distance from the table, such microphones have their own audio pickup challenges due to a closer proximity to loudspeakers and HVAC systems, a further distance from audio sources, and an increased sensitivity to air motion or white noise.

Accordingly, there is an opportunity for systems that address these concerns. More particularly, there is an opportunity for systems including an array microphone that is unobtrusive, easy to install into an existing environment, and can enable the adjustment of the microphone array to optimally detect sounds from an audio source, e.g., a human speaker, and reject unwanted noise and reflections.

SUMMARY

The invention is intended to solve the above-noted problems by providing systems and methods that are designed to, among other things: (1) provide an array microphone assembly that is sized and shaped to be mountable in a drop ceiling in place of a ceiling tile; and (2) provide an array microphone system comprising a concentric configuration of microphones that achieves improved directional sensitivity over the voice frequency range and an optimal main to side lobe ratio over a prescribed steering angle range.

In an embodiment, an array microphone system comprises a substrate and a plurality of microphones arranged, on the substrate, in a number of concentric, nested rings of varying sizes. In said embodiment, tach ring comprises a subset of the plurality of microphones positioned at predetermined intervals along a circumference of the ring.

In another embodiment, a microphone assembly comprises an array microphone comprising a plurality of microphones and a housing configured to support the array microphone. In said embodiment, the housing is sized and shaped to be mountable in a drop ceiling in place of at least one of a plurality of ceiling tiles included in the drop ceiling. Further, a front face of the housing includes a sound-permeable screen having a size and shape that is substantially similar to the at least one of the plurality of ceiling tiles.

In another embodiment, a method of assembling an array microphone comprises arranging a first plurality of microphones to form a first configuration on a substrate and arranging a second plurality of microphones to form a second configuration on the substrate, where the second configuration concentrically surrounds the first configuration. The method further comprises electrically coupling each of the first and second pluralities of microphones to an audio processor for processing audio signals captured by the microphones.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1:
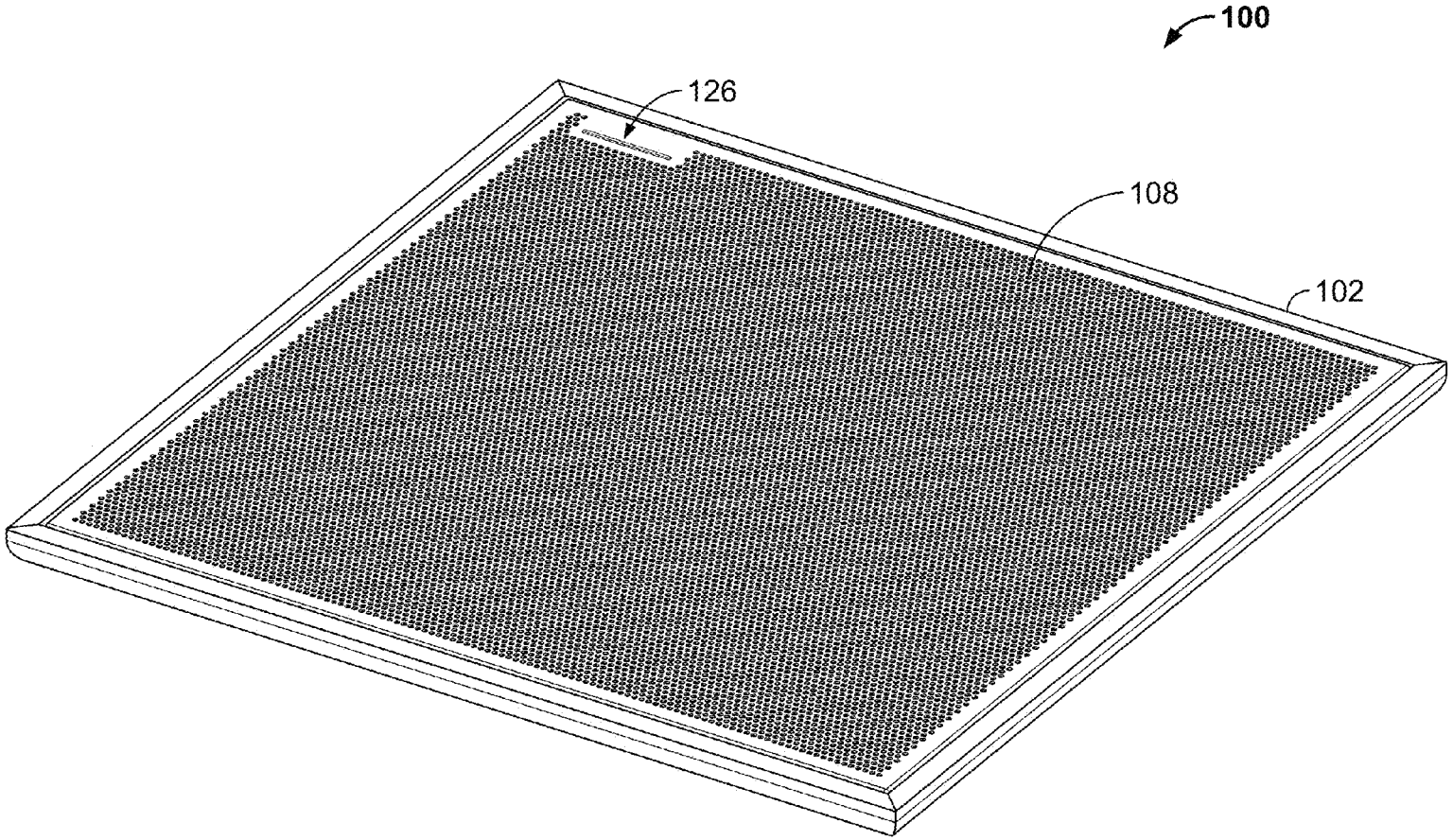
FIG. 1 is a front perspective view of an exemplary array microphone assembly in accordance with certain embodiments.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

With respect to the exemplary systems, components and architecture described and illustrated herein, it should also be understood that the embodiments may be embodied by, or employed in, numerous configurations and components, including one or more systems, hardware, software, or firmware configurations or components, or any combination thereof, as understood by one of ordinary skill in the art. Accordingly, while the drawings illustrate exemplary systems including components for one or more of the embodiments contemplated herein, it should be understood that with respect to each embodiment, one or more components may not be present or necessary in the system.

Systems and methods are provided herein for an array microphone assembly that (1) is configured to be mountable in a drop ceiling of, for example, a conferencing or boardroom environment, in place of an existing ceiling panel, and (2) includes a plurality of microphone transducers selectively positioned in a self-similar or fractal-like configuration, or constellation, to create a high performance array with, for example, an optimal directivity index and a maximal main-to-side-lobe ratio. In embodiments, this physical configuration can be achieved by arranging the microphones in concentric rings, which allows the array microphone to have equivalent beamwidth performance at any given look angle in a three-dimensional (e.g., X-Y-Z) space. As a result, the array microphone described herein can provide a more consistent output than array microphones with linear, rectangular, or square constellations. Further, each concentric ring within the constellation of microphones can have a slight, rotational offset from every other ring in order to minimize side lobe growth, giving the array microphone lower side lobes than existing arrays with co-linearly positioned elements. This offset configuration can also tolerate further beam steering, which allows the array to cover a wider pick up area. Moreover, the microphone constellation can be harmonically nested to optimize beamwidth over a given set of distinct frequency bands.

In embodiments, the array microphone may be able to achieve maximal side lobe rejection across the voice frequency range and over a broad range of array focus (e.g., look) angles due, at least in part, to the use of micro-electrical mechanical system (MEMS) microphones, which allows for a greater microphone density and improved rejection of vibrational noise, as compared to existing arrays. The microphone density of the array constellation can permit varying beamwidth control, whereas existing arrays are limited to a fixed beamwidth. In other embodiments, the microphone system can be implemented using alternate transduction schemes (e.g., condenser, balanced armature, etc.), provided the microphone density is maintained.

Figure 2:
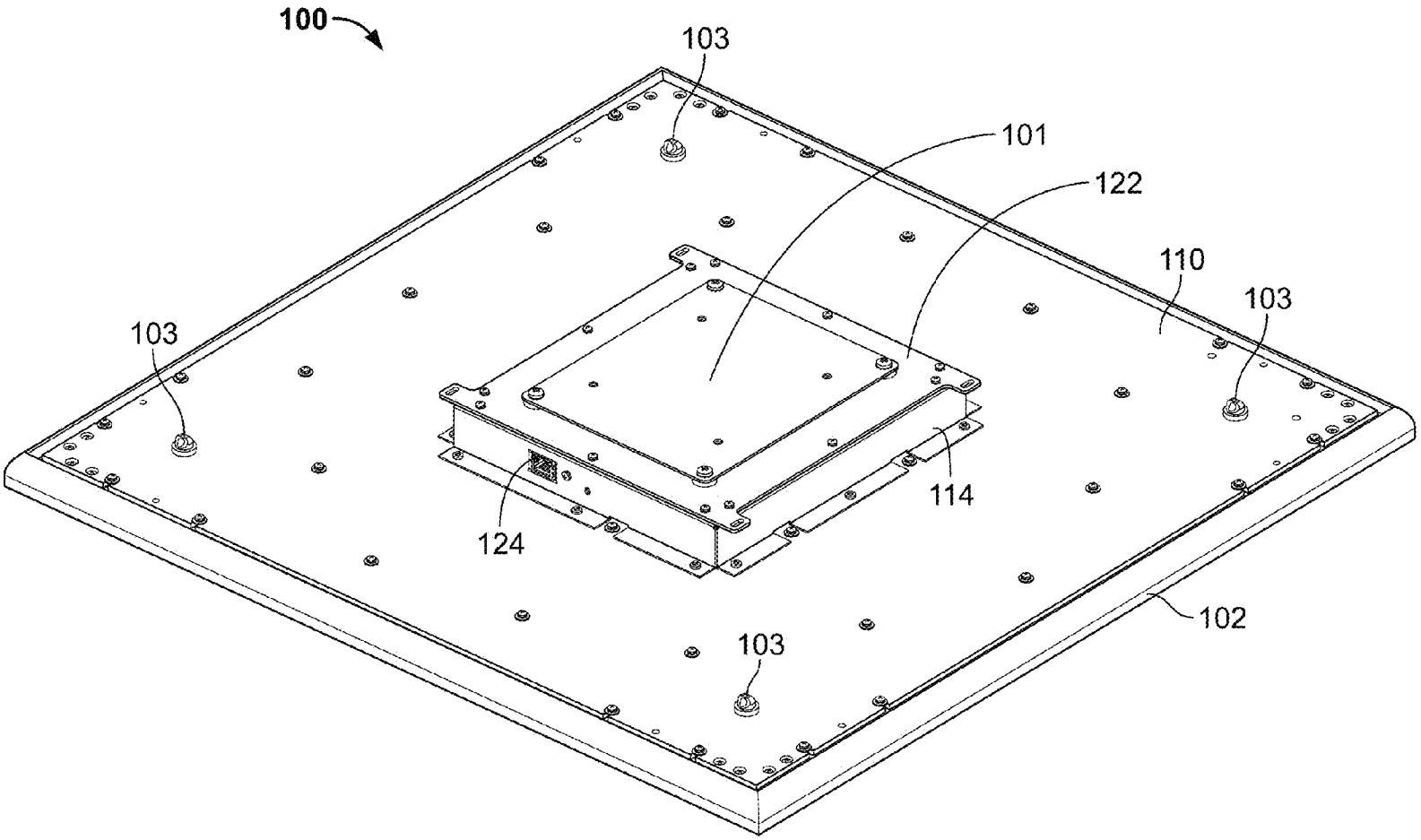
FIG. 2 is a rear perspective view of the array microphone assembly of FIG. 1 in accordance with certain embodiments.
Figure 3:
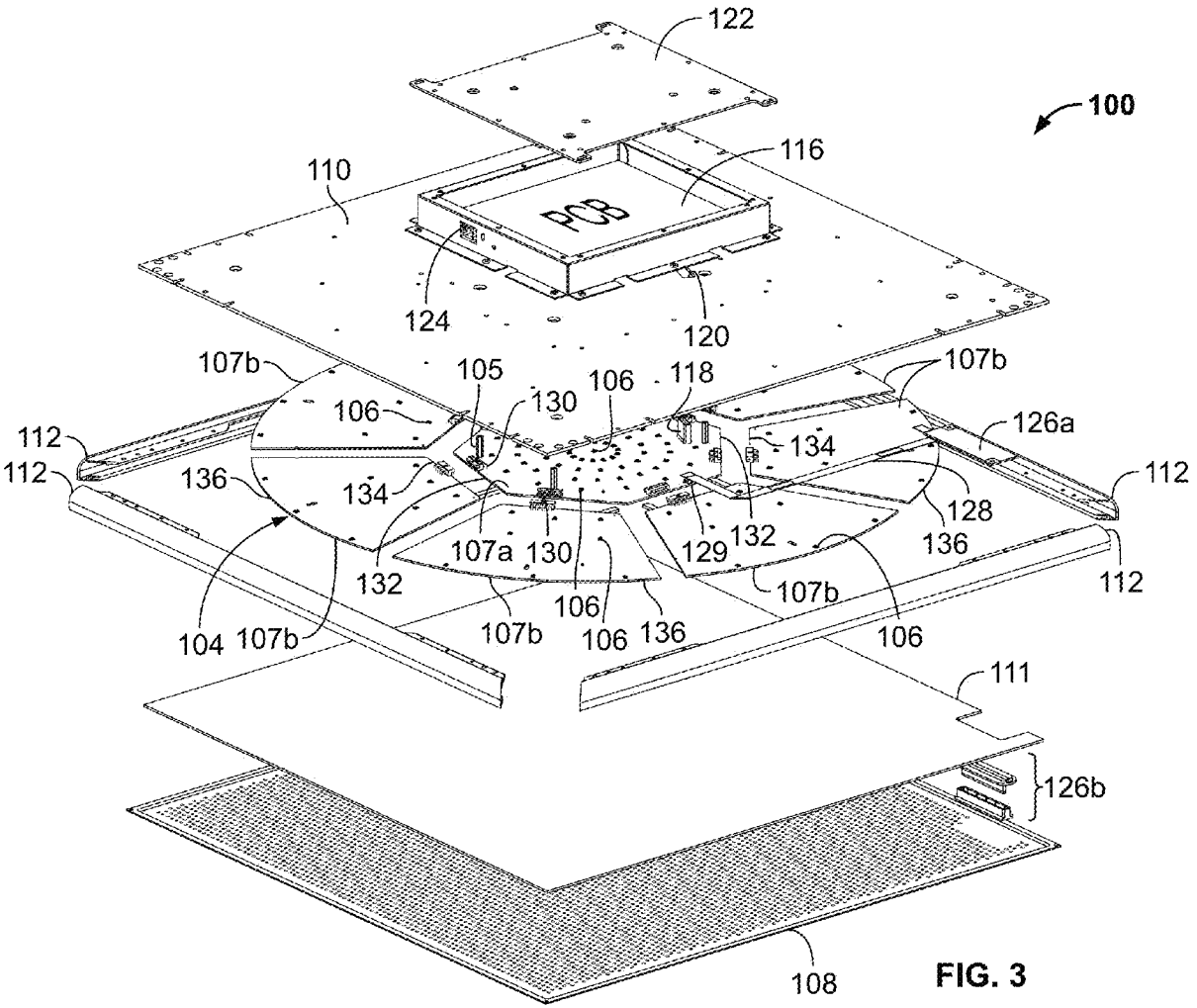
FIG. 3 is an exploded view of the array microphone assembly of FIG. 1 in accordance with certain embodiments.
Figure 4:
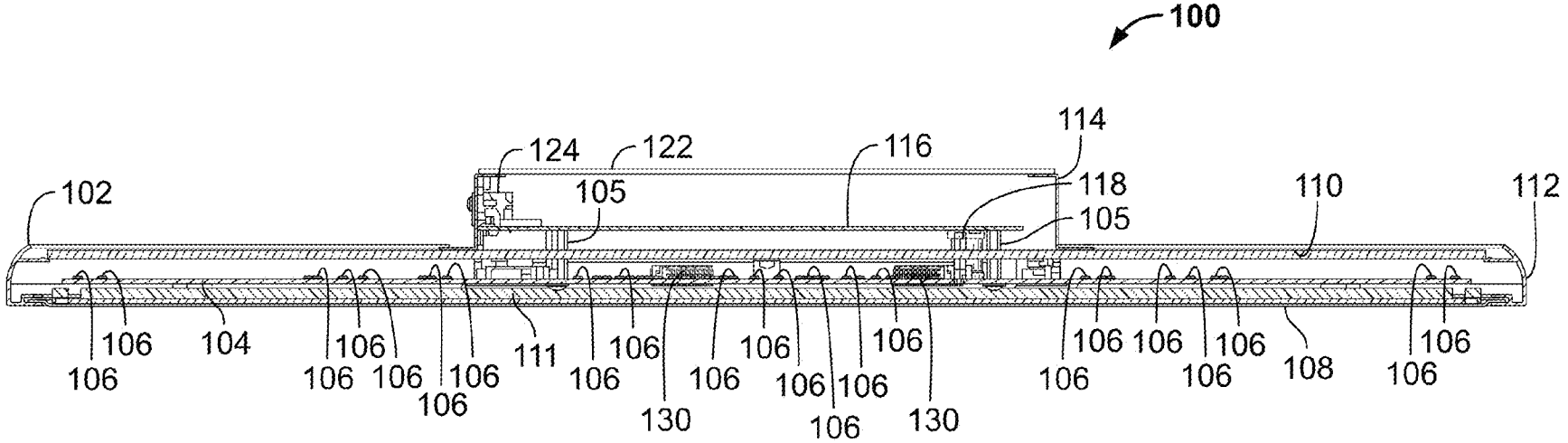
FIG. 4 is a side cross-sectional view of the array microphone assembly of FIG. 3 in accordance with certain embodiments.
Figure 5:
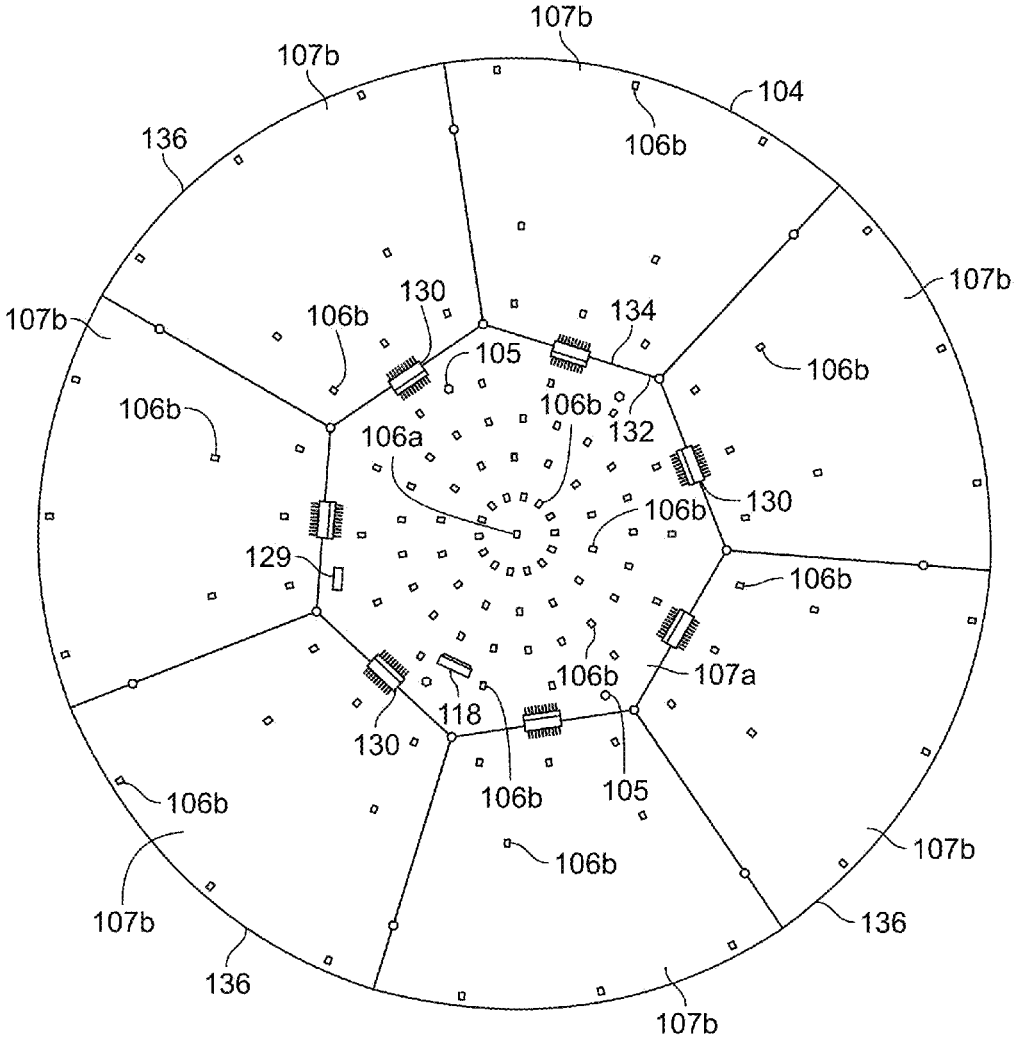
FIG. 5 is a top plan view of the array microphone included in the array microphone assembly of FIG. 3 in accordance with certain embodiments.

FIGS. 1-5 illustrate an exemplary microphone array assembly 100 comprising a housing 102 and an array microphone 104, in accordance with embodiments. More specifically, FIG. 1 depicts a front perspective view of the microphone array assembly 100, FIG. 2 depicts a rear perspective view of the microphone array assembly 100, FIG. 3 depicts an exploded view of the microphone array assembly 100, showing various components of the housing 102 and the microphone array 104 included therein, FIG. 4 depicts a side cross-sectional view of the microphone array assembly 100, and FIG. 5 depicts the microphone array 104, in accordance with embodiments. For the sake of simplicity and illustration, several structural support elements, such as, e.g., screws, washers, rear mounting plate 101, and cable mounting hooks 103, standoffs 105, have been at least partially removed from select views, such as, e.g., FIGS. 3-5.

The array microphone 104 (also referred to herein as "microphone array") comprises a plurality of microphone transducers 106 (also referred to herein as "microphones") configured to detect and capture sounds in an environment, such as, for example, speech spoken by speakers sitting in chairs around a conference table. The sounds travel from the audio sources (e.g., human speakers) to the microphones 106. In some embodiments, the microphones 106 may be unidirectional microphones that are primarily sensitive in one direction. In other embodiments, the microphones 106 may have other directionalities or polar patterns, such as cardioid, subcardioid, or omnidirectional, as desired.

The microphones 106 may be any suitable type of transducer that can detect the sound from an audio source and convert the sound to an electrical audio signal. In a preferred embodiment, the microphones 106 are micro-electrical mechanical system (MEMS) microphones. In other embodiments, the microphones 106 may be condenser microphones, balanced armature microphones, electret microphones, dynamic microphones, and/or other types of microphones.

The microphones 106 can be coupled to, or included on, a substrate 107. In the case of MEMS microphones, the substrate 107 may be one or more printed circuit boards (also referred to herein as "microphone PCB"). For example, in FIG. 5, the microphones 106 are surface mounted to the microphone PCB 107 and included in a single plane. In other embodiments, for example, where the microphones 106 are condenser microphones, the substrate 107 may be made of carbon-fiber, or other suitable material.

As shown in FIGS. 1 and 2, the housing 102 is configured to fully encase the microphone array 104 in order to protect and structurally support the array 104. More specifically, a first or front face of the housing 102 includes a sound-permeable screen or grill 108, and a second or rear face of the housing 102 includes a back panel or support 110. As shown in FIG. 1, the screen 108 can have a perforated surface comprising a plurality of small openings, and can be made of aluminum, plastic, wire mesh, or other suitable material. In other embodiments, the screen 108 may have a substantially solid surface made of sound-permeable film or fabric. As shown in FIG. 3, the housing 102 also includes a membrane 111, made of foam or other suitable material, positioned between the screen 108 and the microphone array 104 to protect the microphone array 104 from external elements, as will be appreciated by those skilled in the pertinent art. As also shown in FIG. 3, the housing 102 further includes side rails 112 for securing each side of the back support 110, the foam membrane 111, and the screen 108 together to form the housing 102. The housing 102 may further include standoffs 105 and spacers (not shown) to mechanically support the microphone array 104 away from other components of the housing 102 and/or the assembly 100.

Figure 6:
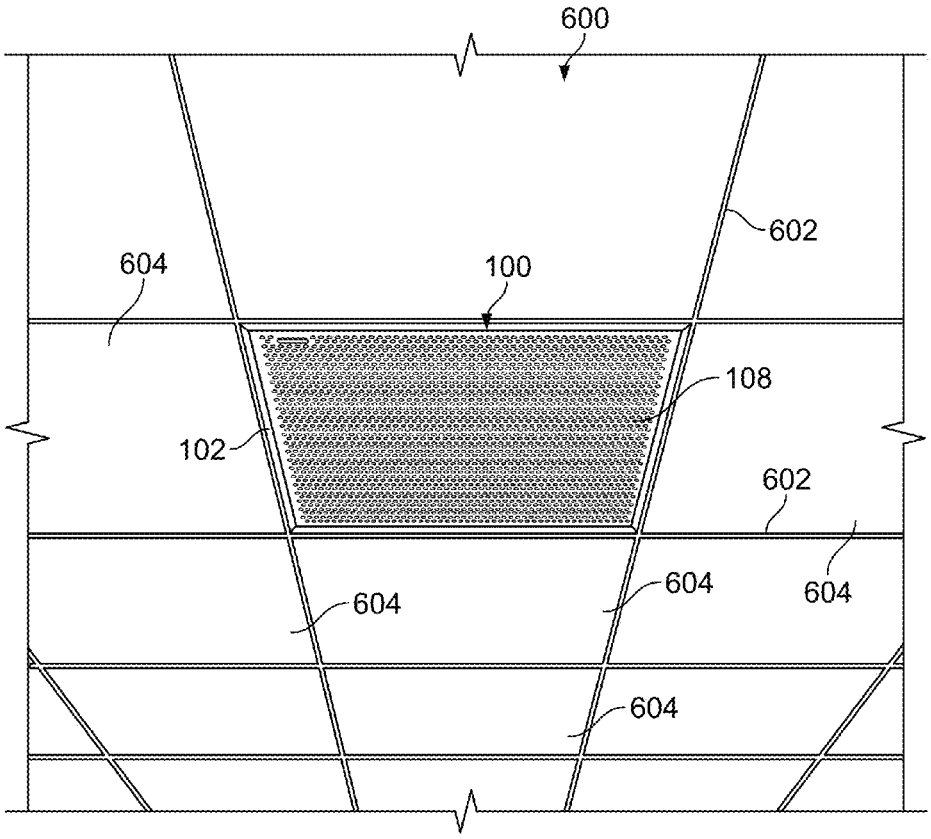
FIG. 6 is an exemplary environment including the array microphone assembly of FIG. 1 in accordance with certain embodiments.

Referring additionally to FIG. 6, shown is an example ceiling 600 with the microphone array assembly 100 installed therein. The ceiling 600 may be part of a conferencing environment, such as, for example, a boardroom where microphones are utilized to capture sound from audio sources or human speakers. In the exemplary environment of FIG. 6, human speakers (not shown) may be seated in chairs at a table below the ceiling 600, or more specifically, below the microphone array assembly 100, although other physical configurations and placements of the audio sources and/or the microphone array assembly 100 are contemplated and possible. In embodiments, the microphone array 104 may be configured for optimal performance at a certain height, or range of heights, above a floor of the environment, for example, in accordance with standard ceiling heights (e.g., eight to ten feet high), or any other appropriate height range.

As shown in FIG. 6, the ceiling 600 may be a drop ceiling (a.k.a. dropped ceiling or suspended ceiling), or a secondary ceiling hung below a main, structural ceiling. As is conventional, the drop ceiling 600 comprises a grid of metal channels 602 that are suspended on wires (not shown) from the main ceiling and form a pattern of regularly spaced cells. Each cell can be filled with a lightweight ceiling tile or panel 604 that, for example, can be removed to provide access for repair or inspection of the area above the tiles. In a preferred embodiment, the ceiling tiles 604 are drop-in tiles that can be easily installed or removed without disturbing the grid or other tiles 604. Each ceiling tile 604 is typically sized and shaped according to a "cell size" of the grid. In the United States, for example, the cell size is typically a square of approximately two feet by two feet, or a rectangle of approximately two feet by four feet. As another example, in Europe, the cell size is typically a square of approximately 600 millimeters (mm) by 600 mm. As yet another example, in Asia, the cell size is typically a square of approximately 625 mm by 625 mm.

In embodiments, the housing 102 can be sized and shaped for installation in the drop ceiling 600 in place of at least one of the ceiling tiles 604. For example, the housing 102 can have length and width dimensions that are substantially equivalent to the cell size of the grid forming the drop ceiling 600. In one embodiment, the housing 102 is substantially square-shaped with dimensions of approximately two feet by two feet (e.g., each of the side rails 112 is about 2 feet long), so that the housing 102 can replace any one of the ceiling tiles 604 in a standard U.S. drop ceiling. In other embodiments, the housing 102 may be sized and shaped to replace two or more of the ceiling tiles 604. For example, the housing 102 may be shaped as an approximately four feet by four feet square to replace any group of four adjoining ceiling tiles 604 that form a square. In other embodiments, the housing 102 can be sized to fit into a standard European drop ceiling (e.g., 600 mm by 600 mm), or a standard Asian drop ceiling (e.g., 625 mm by 625 mm). By mounting the microphone array assembly 100 in place of a ceiling tile 604 of the drop ceiling 600, the assembly 100 can gain acoustic benefits, similar to that of mounting a speaker in a speaker cabinet (such, for example, infinite baffling).

In some cases, an adapter frame (not shown) may be provided to retro-fit or adapt the housing 102 to be compatible with drop ceilings that have a cell size that is larger than the housing 102. For example, the adapter frame may be an aluminum frame that can be coupled around a perimeter of the housing 102 and has a width that extends the dimensions of the housing 102 to fit a predetermined cell size. In such cases, a housing 102 that is sized for standard U.S. ceilings can be adapted to fit, for example, a standard Asian ceiling. In other cases, the housing 102 may be designed to fit a minimum cell size (such as, for example, a 600 mm by 600 mm square), and the adapter frame may be provided in multiple sizes or widths that can extend the dimensions of the housing 102 to fit various different cell sizes (such as, for example, a two feet by two feet square, a 625 mm by 625 mm square, etc.), as needed.

In embodiments, all or portions of the housing 102 may be made of a lightweight, sturdy aluminum or any other material that is light enough to allow the microphone array assembly 100 to be supported by the grid of the drop ceiling 600 and strong enough to enable the housing 102 to support the microphone array 104 mounted therein. For example, in certain embodiments, at least the back panel 110 comprises a flat, aerospace-grade, aluminum board comprising a honeycomb core (e.g., as manufactured by Plascore®). Further, according to certain embodiments, the components of the housing 102 (e.g., the side rails 112, the back portion 110, the screen 108, the microphone array 104, etc.) can be configured to easily fit together for assembly and easily taken apart for disassembly. This feature allows the housing 102 to be customizable according to the end user's specific needs, including, for example, replacing the screen 108 with a different material (e.g., fabric) or color (e.g., to match the color of the ceiling tiles 604); adding or removing an adapter frame to change an overall size of the housing 102, as described above; replacing the side rails 112 to match a color or material of the metal channels 602 in the drop ceiling 600;

replacing or adjusting the array microphone 104 (e.g., in order to provide an array with more or fewer microphones 106); etc.

Figure 7:
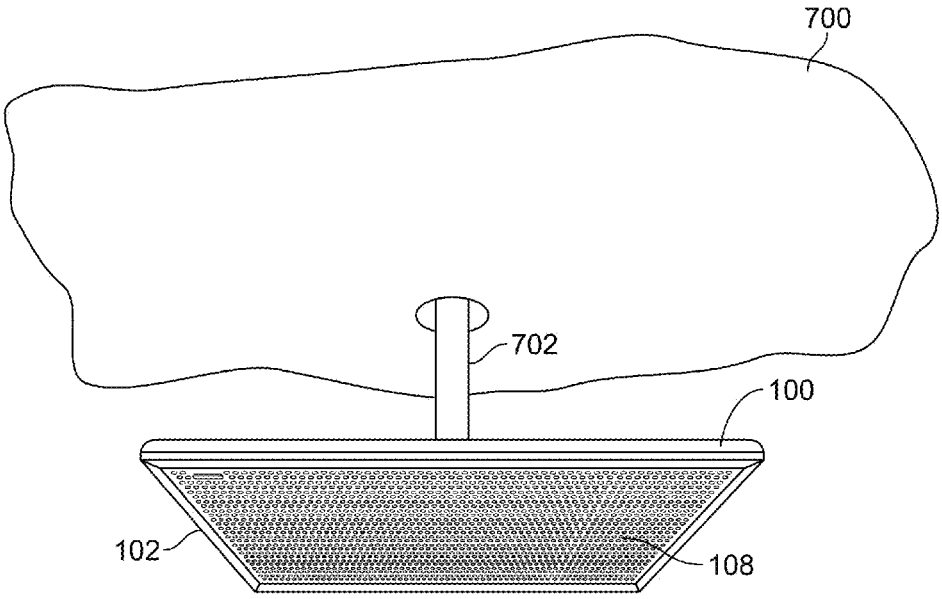
FIG. 7 is another exemplary environment including the array microphone assembly of FIG. 2 in accordance with certain embodiments.
Figure 8:
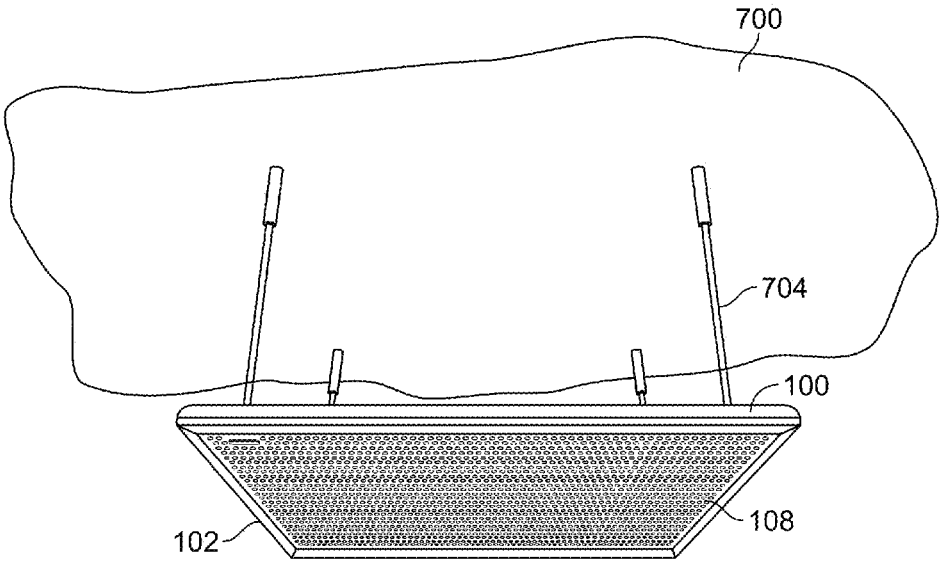
FIG. 8 is another exemplary environment including the array microphone assembly of FIG. 2 in accordance with certain embodiments.

Referring additionally to FIGS. 7 and 8, in embodiments, the housing 102 can be configured to provide alternative mounting options, for example, to accommodate environments that have a ceiling 700 that is not a drop ceiling. In some cases, the microphone array assembly 100 can include the rear mounting plate 101, as shown in FIG. 2. The rear mounting plate 101 can be coupled to a mounting post 702, using a standard VESA mounting hole pattern, the mounting post 702 being configured for attachment to the ceiling 700, as shown in FIG. 7. As shown in FIG. 8, in some cases, the microphone array assembly 100 can be mounted to the ceiling 700 by coupling drop-down ceiling cables 704 to the cable mounting hooks 103 attached to the back support 110 of the housing 102, as shown in FIG. 2. In still other embodiments, the housing 102 can be configured to provide a wall-mounting option and/or for placement in front of a performance area, such as a stage.

Referring now to FIGS. 2-4, the microphone array assembly 100 includes a control box 114 mounted on the back support 110. As shown in FIGS. 3 and 4, the control box 114 houses a printed circuit board 116 (also referred to herein as "audio PCB") that is electrically coupled to the microphone array 104. For example, the audio PCB 116 can be coupled to the microphone array 104, or more specifically, the substrate 107, through a board-to-board connector 118 that extends vertically from the microphone array 104 through an opening 120 in the back support 110, as shown in FIGS. 3 and 4. In embodiments, the audio PCB 116 can be configured as an audio processor (e.g., through hardware and/or software elements) to process audio signals received from and captured by the microphone array 104 and to produce a corresponding audio output, as discussed in more detail herein. As illustrated, the control box 114 can include a removable cover 122 to provide access to the audio PCB 116 and/or other components within the control box 114.

In embodiments, the microphone array assembly 100 includes an external port 124 mechanically coupled to the control box 114 and configured to electrically couple a cable (not shown) to the audio PCB 116. The cable may be a data, audio, and/or power cable, depending on the type of information being conveyed through the port 124. For example, upon coupling the cable thereto, the external port 124 can be configured to receive control signals from an external control device (e.g., an audio mixer, an audio recorder/amplifier, a conferencing processor, a bridge, etc.) and provide the control signals to the audio PCB 116. Further, the port 124 can be configured to transmit or output, to the external control device, audio signals received at the audio PCB 116 from the microphone array 104. In some cases, the external port 124 can be configured to provide power from an external power supply (e.g., a battery, wall outlet, etc.) to the audio PCB 116 and/or the microphone array 104. In a preferred embodiment, the external port 124 is an Ethernet port configured to receive an Ethernet cable (e.g., CAT5, CAT6, etc.) and to provide power, audio, and control connectivity to the microphone array assembly 100. In other embodiments, the external port 124 can include a number of ports and/or can include any other type of data, audio, and/or power port including, for example, a Universal Serial Bus (USB) port, a mini-USB port, a PS/2 port, an HDMI port, a serial port, a VGA port, etc.

Referring now to FIGS. 1 and 3, the microphone array assembly 100 further includes an indicator 126 that visually indicates an operating mode or status of the microphone array 104 (e.g., power on, power off, mute, audio detected, etc.). As shown in FIG. 1, the indicator 126 can be integrated into the screen 108, so that the indicator 126 is visible on an exterior of the front face of the housing 102, to externally indicate the operating mode of the microphone array 104 to human speakers or others in the conferencing environment. In embodiments, the indicator 126 (also referred to herein as "external indicator") comprises at least one light source (not shown), such as, for example, a light emitting diode (LED), that is turned on or off in accordance with an operating mode (e.g., power on or off) of the array microphone assembly 100. In some embodiments, the light indicator 126 can turn on a first light source to indicate a first operating mode (e.g., power on) of the microphone array assembly 100, turn on a second light source to indicate a second operating mode (e.g., audio detected), such that, in some instances, both light sources may be on at the same time. In a preferred embodiment, the indicator 126 includes at least one LED (not shown) mounted to a PCB 126*a* (also referred to herein as "LED PCB") and a light guide 126*b* configured to optically direct the light from the LED to outside the screen 108, as shown in FIG. 3. The LED can be electrically coupled to the microphone array 104 via a cable 128 that connects the LED PCB 126*a* to a connector 129 on the microphone PCB 107, as shown in FIGS. 3 and 5.

Referring now to FIGS. 3 and 5, in embodiments, the substrate 107 of the microphone array assembly 100 can include a central PCB 107*a* and one or more peripheral PCBs 107*b* positioned around the central board to increase an available space for mounting the microphones 106. For example, a portion of the microphones 106 may be mounted on the central PCB 107*a* and a remainder of the microphones 106 may be mounted on the peripheral PCBs 107*b*, as will be explained in more detail below. Each of the peripheral PCBs 107*b* can be coupled to the central PCB 107*a* using one or more board-to-board connectors 130. In a preferred embodiment, the microphones 106 are all mounted in one plane of the substrate 107, as shown in FIG. 4.

The number, size, and shape of the one or more peripheral PCBs 107*b* can vary depending on, for example, a number of sides 130, size and/or shape of the central PCB 107*a*, as well as an overall shape of the substrate 107. For example, in the illustrated embodiment, the central PCB 107*a* is a polygon with seven uniform sides 132, and the substrate 107 includes seven peripheral PCBs 107*b* respectively coupled to each side 132 at an inner end 134 of each peripheral PCB 107*b*. As illustrated, the inner ends 134 are flat surfaces uniformly sized to match any one of the seven sides 132. Each peripheral PCB 107*b* can further include an outer end 136 that is opposite the inner end 134. In the illustrated embodiment, the substrate 107 is shaped as a circle, and therefore, the outer end 136 of each peripheral PCB 107*b* is curved.

In other embodiments, the central PCB 107*a* can have other overall shapes, including, for example, other types of polygons (e.g., square, rectangle, triangle, pentagon, etc.), a circle, or an oval. In such cases, the inner ends 134 of the peripheral PCBs 107*b* may be sized and shaped according to the size and shape of the sides 132 of the central PCB 107*a*. For example, in one embodiment, the central PCB 107 may have a circular shape such that each of the sides 132 is curved, and therefore, the inner ends 134 of the peripheral PCBs 107*b* may also be curved. Likewise, in other embodiments, the substrate 107 can have other overall shapes, including, for example, an oval or a polygon, and the outer ends 136 of the peripheral PCB 107*b* can be shaped accordingly. In still other embodiments, the substrate 107 can include a donut-shaped peripheral PCB 107*b* surrounding a circular central PCB 107*a*, or a single, continuous board 107 comprising all of the microphone transducers 106.

As shown in FIG. 5, in embodiments, the plurality of microphones 106 includes a central microphone 106*a* positioned at a central point of the central PCB 107*a* and a remaining set of the microphones 106*b* that are arranged in a fractal, or self-similar, configuration surrounding the central microphone 106*a* and positioned on either the central PCB 107*a* or the peripheral PCB 107*b*. Due, at least in part, to the fractal-like placement of the microphones 106, the array microphone 104 can achieve improved directional sensitivity across the voice frequency range and maximal main-to-side-lobe ratio over a prescribed steering angle range. As a result, the microphone array 104 can more precisely "listen" for signals coming from a single direction and reject unwanted noise and/or interference sounds, and can more effectively differentiate between adjacent human speakers. In addition, the fractal nature of the microphone configuration allows the directivity of the array 104 to be easily extensible to a wider frequency range (e.g., lower and/or higher frequencies) by adding more microphones and/or creating a larger-sized microphone array 104.

More specifically, in embodiments, the microphones 106 can be arranged in concentric, circular rings of varying sizes, so as to avoid undesired pickup patterns (e.g., due to grating lobes) and accommodate a wide range of audio frequencies. As used herein, the term "ring" may include any type of circular configuration (e.g., perfect circle, near-perfect circle, less than perfect circle, etc.), as well as any type of oval configuration or other oblong loop. As shown in FIG. 5, the rings can be positioned at various radial distances from the central microphone 106*a*, or a central point of the substrate 107, to form a nested configuration that can handle progressively lower audio frequencies, with the outermost ring being configured to optimally operate at the lowest frequencies in the predetermined operating range. Using harmonic nesting techniques, the concentric rings can be used to cover a specific frequency bands within a range of operating frequencies.

In embodiments, each ring contains a different subset of the remaining microphones 106*b*, and each subset of microphones 106*b* can be positioned at predetermined intervals along a circumference of the corresponding ring. The predetermined interval or spacing between neighboring microphones 106*b* within a given ring can depend on a size or diameter of the ring, a number of microphones 106*b* included in the subset assigned to that ring, and/or a desired sensitivity or overall sound pressure for the microphones 106*b* in the ring. Increasing the number of microphones 106 and a microphone density of the rings (e.g., due to nesting of the rings) can help remove grating lobes and thereby, produce an improved beamwidth with a near constant frequency response across all frequencies within the preset range.

As will be appreciated, FIG. 5 only shows an exemplary embodiment of the array microphone 104 and other configurations of the microphones 106 are contemplated in accordance with the principles disclosed herein. For example, in some embodiments, the plurality of microphones 106 may be arranged in concentric rings around a central point, but without any microphone positioned at the central point (e.g., without the central microphone 106*a*). In still other embodiments, only a portion of the microphones 106 may be arranged in concentric rings, and the remaining portion of the microphones 106 may be positioned at various points outside of, or in between, the discrete rings, at random locations on the substrate 107, or in any other suitable arrangement.

Figure 9:
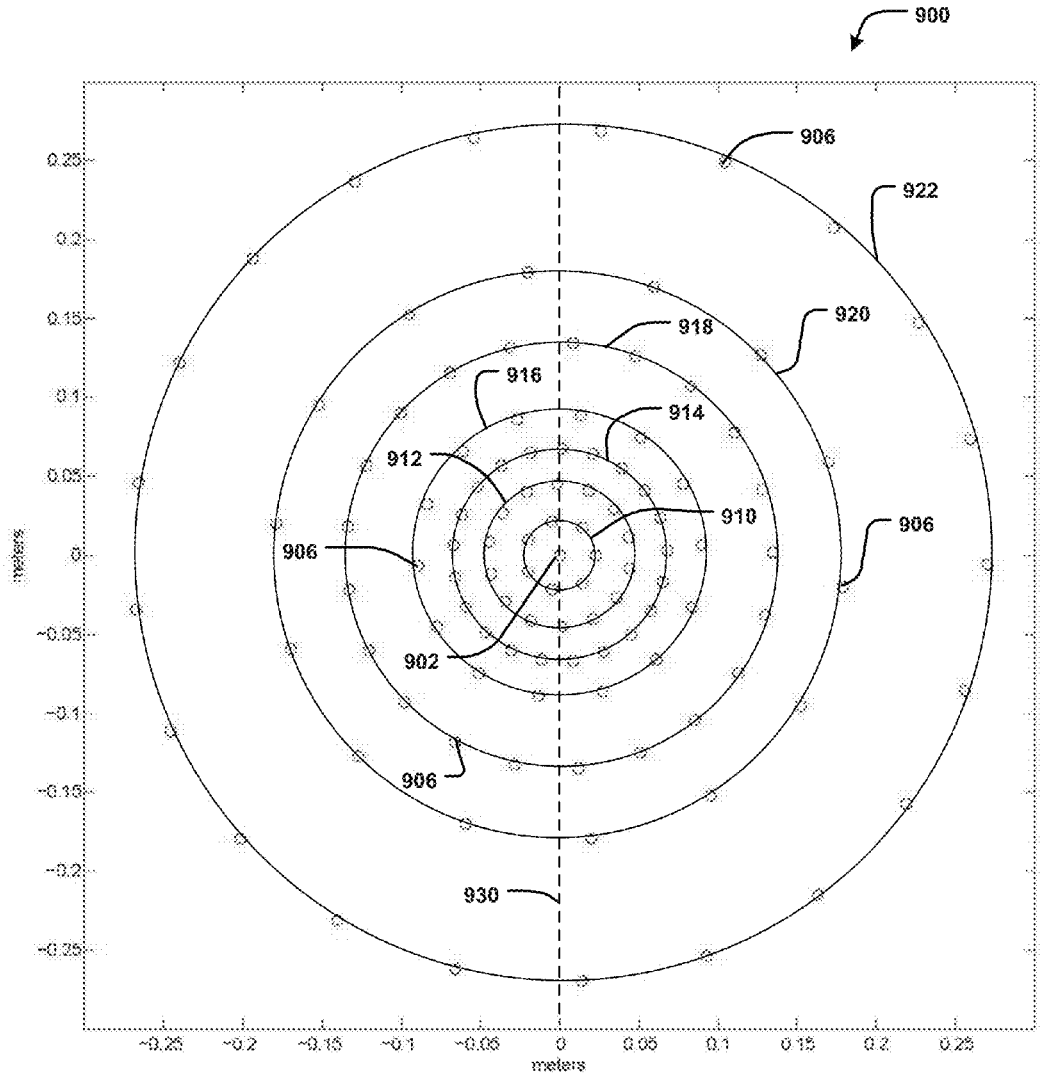
FIG. 9 is a graph showing microphone placement in another example array microphone in accordance with certain embodiments.

FIG. 9 graphically depicts an exemplary microphone configuration 900 that may be found in an array microphone in accordance with certain embodiments. The microphone configuration 900 may be substantially similar to the self-similar configuration of microphones 106 included the microphone array 104, except for the number of microphones 106*b* included in an innermost ring of the array 104. As shown, the microphone configuration 900 includes one microphone 902 (e.g., the central microphone 106*a*) located at a center of the configuration 900 and a plurality of microphones 906 (e.g., the remaining set of microphones 106*b*) arranged in seven concentric rings 910-922. For ease of explanation and illustration, a circle has been drawn through each group of microphones 906 that forms the rings of the microphone configuration 900.

In order to accommodate the microphones 906, the microphone configuration 900 may be mounted on a plurality of printed circuit boards (not shown), similar to the central PCB 107*a* and the plurality of peripheral PCBs 107*b*. For example, referring now to FIG. 5 as well, the microphones 906 may include (i) a first subset of the microphones 902 mounted on the central PCB 107*a* to form a first ring 910 surrounding the central microphone 906, (ii) a second subset of the microphones 906 mounted on the central PCB 107*a* to form a second ring 912 surrounding the first ring 910, (iii) a third subset of the microphones 906 that are mounted on the central PCB 107*a* to form a third ring 914 surrounding the second ring 912, (iv) a fourth subset of the microphones 906 mounted on the central PCB 107*a* to form a fourth ring 918 surrounding the third ring 916, (v) a fifth subset of the microphones 906 mounted on the peripheral PCBs 107*b* to form a fifth ring 916 surrounding the fourth ring 914, (vi) a sixth subset of the microphones 906 mounted on the peripheral PCBs 107*b* to form a sixth ring 920 surrounding the fifth ring 918, and (vii) a seventh subset of the microphones 906 mounted on, and near an edge of, the peripheral PCBs 107*b* to form a seventh ring 922 surrounding the sixth ring 920.

In embodiments, the number of rings 910-922 included in the microphone array, a diameter of each ring, and/or the radial distance between neighboring rings can vary depending on the desired frequency range over which the array microphone is configured to operate and what percentage of that range will be covered by each ring. In embodiments, the diameter of each ring in the microphone array defines the lowest frequency at which the subset of microphones within that ring can operate without picking up unwanted signals (e.g., due to grating lobes). As such, the diameter of the outermost ring 922 can determine a lower end of the operational frequency range of the microphone array, and the remaining ring diameters can be determined by subdividing the remaining frequency range. For example and without limitation, in some embodiments, the microphone array can be configured to cover an operational frequency range of at least 100 hertz (Hz) to at least 10 kilohertz (KHz), with each ring covering, or contributing to coverage of, a different octave or other frequency band within this range. As a further example, in such embodiments, the outermost ring 922 may be configured to cover the lowest frequency band (e.g., 100 Hz), and the remaining rings 910-920, either alone or in combination with one or more other rings, may contribute to coverage of the remaining octaves or bands (e.g., frequency bands starting at 200 Hz, 400 Hz, 800 Hz, 1600 Hz, 3200 Hz, and/or 6400 Hz).

As will be appreciated, side lobes may be present in a polar response of a microphone array, in addition to a main lobe of the array beam, the result of undesired, extraneous pick-up sensitivity at angles other than the desired beam angle. Because side lobes can change in magnitude and frequency sensitivity as the array beam is steered, a beam that typically has very small side lobes relative to a main lobe can have a much larger side lobe response once the beam is steered to a different direction. In some cases, the side lobe sensitivity can even rival the main lobe sensitivity at certain frequencies. However, in embodiments, including more microphones 906 within the microphone array can strengthen the main lobe of a given beam and thereby, reduce the ratio of side lobe sensitivity to main lobe sensitivity.

In embodiments, the rings 910-922 may be at least slightly rotated relative to a central axis 930 that passes through a center of the array (e.g., the central microphone 902) in order to optimize the directivity of the microphone array. In such cases, the microphone array can be configured to constrain microphone sensitivity to the main lobes, thereby maximizing main lobe response and reducing side lobe response. In some embodiments, the rings 910-922 can be rotationally offset from each other, for example, by rotating each ring a different number of degrees, so that no more than any two microphones 906 are axially aligned. For example, in microphone arrays with a smaller number of microphones, this rotational offset may be beneficial to reduce an undesired acoustic signal pickup that can occur when more than two microphones are aligned. In other embodiments, for example, in arrays with a large number of microphones, the rotational offset may be more arbitrarily implemented, if at all, and/or other methods may be utilized to optimize the overall directivity of the microphone array.

Referring back to FIG. 5, in embodiments, each of the peripheral PCBs 107*b* can be uniformly designed to streamline manufacturing and assembly. For example, as shown in FIG. 5, each peripheral PCB 107*b* can have a uniform shape, and the microphones 106*b* can be placed in identical locations on each board 107*b*. In this manner, any one of the peripheral PCBs 107*b* can be coupled to any one of the connectors 130 in order to electrically couple the peripheral PCB 107*b* to the central PCB 107*a*. For example, in the illustrated embodiment, the microphone PCB 107 includes seven peripheral PCBs 107*b* so that each of the peripheral PCBs 107*b* can include eight microphones in uniform locations. The remaining 64 microphones are included on the central PCB 107*a*, so that the microphone array 104 includes a total of 120 microphones.

In embodiments, the total number of microphones 106 and/or the number of microphones 106*b* on the central PCB 107*a* and/or each of the peripheral PCBs 107*b* may vary depending on, for example, the configuration of the harmonic nests, a preset operating frequency range of the array 104, an overall size of the microphone array 104, as well as other considerations. For example, in FIG. 9, the microphone configuration 900 includes only 113, or more specifically, one central microphone surrounded by 112 microphones 906, because the ring 910 includes seven fewer microphones 906 than the corresponding ring of the microphone array 104 in FIG. 5. In certain embodiments, removing these seven microphones from the first or innermost ring 910 can be achieved with little to no loss in frequency coverage or microphone sensitivity.

In embodiments, the number of microphones 906 included in each of the rings 910-922 can be selected to create a self-similar or repeating pattern in the microphone configuration 900. This can allow the microphone configuration 900 to be easily extended by adding one or more rings, in order to cover more audio frequencies, or easily reduced by removing one or more rings, in order to cover fewer frequencies. For example, in the illustrated embodiments of FIGS. 5 and 9, a fractal or self-similar configuration is formed by placing 7, 14, or 21 microphones 106*b*/906 (e.g., a multiple of 7) in each of the seven rings 910-922. Other embodiments may include other repeatable arrangements of the microphones 106*b*/906, such as, for example, multiples of another integer greater than one, or any other pattern that can simplify manufacturing of the array microphone 104. For example and without limitation, in one embodiment, the number of microphones 906 in each of the inner rings 910-920 may alternate between two numbers (e.g., 8 and 16), while the outermost ring 922 may include any number of microphones 906 (e.g., 20).

As will be appreciated, in other embodiments, the microphones 106/906 may be arranged in other configuration shapes, such as, for example, ovals, squares, rectangles, triangles, pentagons, or other polygons, have more or fewer subsets or rings of microphones 106/906, and/or have a different number of microphones 106/906 in each of the rings 910-922 depending on, for example, a desired distance between each ring, an overall size of the substrate 107, a total number of microphones 106 in the array 104, a preset audio frequency range covered by the array 104, as well as other performance- and/or manufacturing-related considerations.

Figure 10:
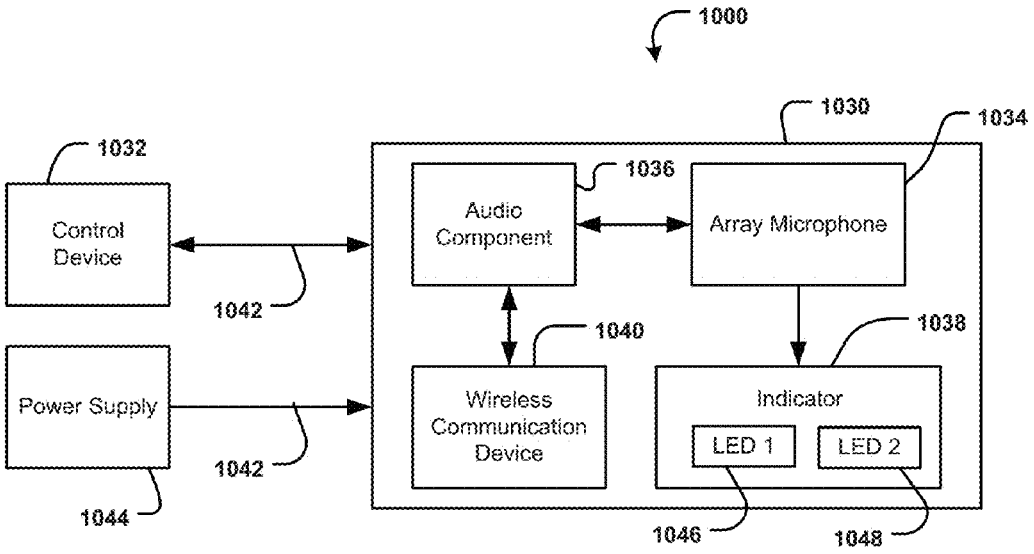
FIG. 10 is a block diagram depicting an example array microphone system in accordance with certain embodiments.

FIG. 10 illustrates a block diagram of an exemplary audio system 1000 comprising an array microphone system 1030 and a control device 1032. The array microphone system 1030 may be configured similar to the array microphone assembly 100 shown in FIGS. 1-5, or in other configurations. For example, the array microphone system 1030 may include an array microphone 1034 that is similar to the array microphone 104. The array microphone system 1030 may also include an audio component 1036 that receives audio signals from the array microphone 1034 and is configured as an audio recorder, audio mixer, amplifier, and/or other component for processing of audio signals captured by the microphone array 1034. In such embodiments, the audio component 1036 may be at least partially included on a printed circuit board (not shown), such as, e.g., the audio PCB 116. In other embodiments, the audio component 1036 is located in the audio system 1000 independently of the array microphone system 1030, and the array microphone system 1030 (e.g., within the control device 1032) may be in wired or wireless communication with the audio component 1036. The array microphone system 1030 may further include an indicator 1038 similar to the indicator 126 to visually indicate an operating mode of the microphone array 1034 on a front exterior of the array microphone system 1030.

The control device 1032 may be in wired or wireless communication with the array microphone system 1030 to control the audio component 1036, the microphone array 1034, and/or the indicator 1038. For example, the control device 1036 may include controls to activate or deactivate the microphone array 1034 and/or the indicator 1038. Controls on the control device 1036 may further enable the adjustment of parameters of the microphone array 1034, such as directionality, gain, noise suppression, pickup pattern, muting, frequency response, etc. In embodiments, the control device 1036 may be a laptop computer, desktop computer, tablet computer, smartphone, proprietary device, and/or other type of electronic device. In other embodiments, the control device 1036 may include one or more switches, dimmer knobs, buttons, and the like.

In some embodiments, the microphone array system 1030 includes a wireless communication device 1040 (e.g., a radio frequency (RF) transmitter and/or receiver) for facilitating wireless communication between the system 1030 and the control device 1036 and/or other computer devices (e.g., by transmitting and/or receiving RF signals). For example, the wireless communication may be in the form of an analog or digital modulated signal and may contain audio signals captured by the microphone array 1034 and/or control signals received from the control device 1036. In some embodiments, the wireless communication device 1040 may include a built-in web server for facilitating web conferencing and other similar features through communication with a remote computer device and/or server.

In some embodiments, the array microphone system 1030 includes an external port (not shown) similar to the external port 124, and the system 1030 is in wired communication with the control device 1036 via a cable 1042 coupled to the port 124. In one such embodiment, the audio system 1000 further includes a power supply 1044 that is also coupled to the array microphone system 1030 via the cable 1042, such that the cable 1042 carries power, control, and/or audio signals between various components of the audio system 1000. In a preferred embodiment, the cable 1042 is an Ethernet cable (e.g., CAT5, CAT6, etc.). In other embodiments, the power supply 1044 is coupled to the array microphone system 1030 via a separate power cable.

As illustrated, the indicator 1038 can include a first light source 1046 and a second light source 1048. The first light source 1046 may be configured to indicate a first operating mode or status of the microphone array 1034 by turning the light on or off, and likewise, the second light source 1048 may be configured to indicate a second operating mode of the microphone array 1034. For example, the first light source 1046 may indicate whether or not the microphone array system 1030 has power (e.g., the light 1046 turns on if the system 1030 is turned on), and the second light source 1048 may indicate whether or not the microphone array 1034 has been muted (e.g., the light 1048 turns on if the system 1030 has been set to a mute setting). In other cases, at least one of the light sources 1046, 1048 may indicate whether or not audio is being received from an outside audio source (e.g., during web conferencing). In a preferred embodiment, the first light source 1046 is a first LED with a first light color, and the second light source 1048 is a second LED with a second light color that is different from the first light color (e.g., blue, green, red, white, etc.). The indicator 1038 can be in electronic communication with and controlled by the control device 1032 and/or the audio component 1036, for example, to determine which operating mode(s) can be indicated by the indicator 1038 and which color(s), LED(s), or other forms of indication are assigned to each operating mode.

In embodiments, the audio component 1036 can be configured (e.g., via computer programming instructions) to enable adjustment of parameters of the microphone array 1034, such as directionality, gain, noise suppression, pickup pattern, muting, frequency response, etc. Further, the audio component 1036 may include an audio mixer (not shown) to enable mixing of the audio signals captured by the microphone array 1034 (e.g., combining, routing, changing, and/or otherwise manipulating the audio signals). The audio mixer may continuously monitor the received audio signals from each microphone in the microphone array 1034, automatically select an appropriate (e.g., best) lobe formed by the microphone array 1034 for a given human speaker, automatically position or steer the selected lobe directly towards the human speaker, and output an audio signal that emphasizes the selected lobe while suppressing signals from the other audio sources.

Figure 11:
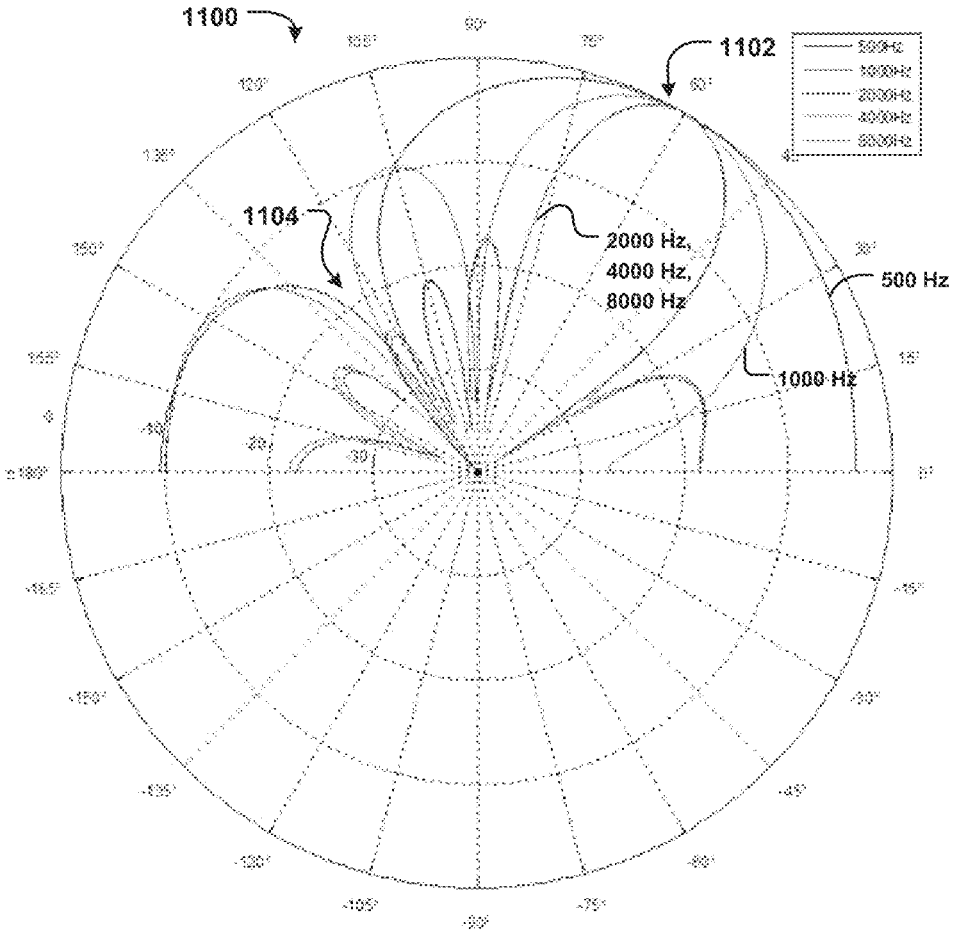
FIG. 11 is a polar plot showing select polar responses of the array microphone of FIG. 9 in accordance with certain embodiments.

In embodiments, in order to accommodate the possibility of several human speakers speaking simultaneously (e.g., in a boardroom environment), the microphone array 1034 can be configured to simultaneously form up to eight lobes at any angle around the microphone array 1034, for example, to emulate up to eight seated positions at a table. Due to its microphone configuration (e.g., the microphone configuration 900), the microphone array 1034 can form relatively narrow lobes (e.g., as shown in FIG. 11) to pick up less of the unwanted audio signals (e.g., noise) in an environment. The lobes can be steerable so as to provide audio pick-up coverage of human speakers positioned at any point 360 degrees around the array 1034. For example, the audio component 1036 may be configured (e.g., using computer programming instructions) to allow the lobes to be steered or adjusted to any point in a three-dimensional space covering azimuth, elevation, and distance or radius. In embodiments, the beam pattern of the microphone array 1034 can be electronically steered without physically moving the array 1034.

Further, the audio mixer may be configured to simultaneously provide up to eight individually-routed outputs or channels (not shown), each output corresponding to a respective one of the eight lobes of the microphone array 1034 and being generated by combining the inputs received from all microphones in the microphone array 1034. The audio mixer may also provide a ninth auto-mixed output to capture all other audio signals. As will be appreciated, the microphone array 1034 can be configured to have any number of lobes.

According to embodiments, the lobes of the microphone array 1034 can be configured to have an adjustable beamwidth that allows the audio component 1036 to effectively track, and capture audio from, human speakers as they move within the environment. In some cases, the microphone array system 1030 and/or the control device 1032 may include a user control (not shown) that allows manual beamwidth adjustment. For example, the user control may be a knob, slider, or other manual control that can be adjusted between three settings: normal beamwidth, wide beamwidth, and narrow beamwidth. In other cases, the beamwidth control can be configured using software running on the audio component 1036 and/or the control device 1032.

In environments where multiple microphone array systems 1030 are included, for example, to cover a very large conference room, the audio system 1000 may include an audio mixer that receives the outputs from the audio components 1036 included in each microphone array system 1030 and outputs a mixed output based on the received audio signals.

The audio component 1036 may also include an audio amplifier/recorder (not shown) that is in wired or wireless communication with the audio mixer. The audio amplifier/recorder may be a component that receives the mixed audio signals from the audio mixer and amplifies the mixed audio signals for output to a loudspeaker, headphones, live radio or TV feeds, etc., and/or records the received signals onto a medium, such as flash memory, hard drives, solid state drives, tapes, optical media, etc. For example, the audio amplifier/recorder may disseminate the sound to an audience through loudspeakers located in the environment 600, or to a remote environment via a wired or wireless connection.

The connections between the components shown in FIG. 10 are intended to depict the potential flow of control signals, audio signals, and/or other signals over wired and/or wireless communication links. Such signals may be in digital and/or analog formats.

In embodiments, the microphone array 1034 includes a plurality of MEMS microphones (e.g., the microphones 906) arranged in a self-similar or repeating configuration comprising concentric, nested rings of microphones (e.g., the rings 910-922) surrounding a central microphone (e.g., the microphone 902). MEMS microphones can be very low cost and very small sized, which allows a large number of microphones to be placed in close proximity in a single microphone array. For example, in embodiments, the microphone array 1034 includes between 113 and 120 microphones and has a diameter of less than two feet (e.g., to fit in place of a two feet by two feet ceiling tile). Further, by using MEMS microphones in the microphone array 1034, the audio component 1036 may require less programming and other software-based configuration. More specifically, because MEMS microphones produce audio signals in a digital format, the audio component 1036 need not include analog-to-digital conversion/modulation technologies, which reduces the amount of processing required to mix the audio signals captured by the microphones. In addition, the microphone array 1034 may be inherently more capable of rejecting vibrational noise due to the fact that MEMS microphones are good pressure transducers but poor mechanical transducers, and have good radio frequency immunity compared to other microphone technologies.

FIG. 11 is a diagram of an example microphone polar pattern 1100 in accordance with embodiments. The polar pattern 1100 represents the directionality of a given microphone array (e.g., the microphone array 1034/104 or a microphone array having the microphone configuration 900), or more specifically, indicates how sensitive the microphone array is to sounds arriving at different angles about a central axis of the microphone array. In particular, the polar pattern 1100 shows polar responses of the microphone array at each of frequencies 500 Hz, 1000 Hz, 2000 Hz, 4000 Hz, and 8000 Hz, with the microphone array being configured to form a lobe 1102, or a directional beam, at each of these frequencies and the lobe 1102 being steered to an elevation of 60 degrees relative to the plane of the array. As will be appreciated, while the polar plot 1100 shows the polar responses of a single lobe 1102 at selected frequencies, the microphone array is capable of creating multiple simultaneous lobes in multiple directions, each with equivalent, or at least substantially similar, polar response.

As shown by the polar pattern 1100, at the 1000 Hz frequency, side lobes 1104 are formed at 10 decibels (dB) below the main lobe 1102. Further, as shown in FIG. 11, the low frequency response at 500 Hz has a large beamwidth, representing lower directivity, while the higher frequency responses at 1000 Hz, 2000 Hz, 4000 Hz, and 8000 Hz each have a narrow beamwidth, representing high directivity. Thus, in embodiments, the microphone array can provide a high overall directivity index (e.g., 19 dB) across the voice frequency range with a high level of side lobe rejection and an optimal main-to-side-lobe ratio (e.g., 10 dB) over a prescribed steering angle range.

Figure 12:
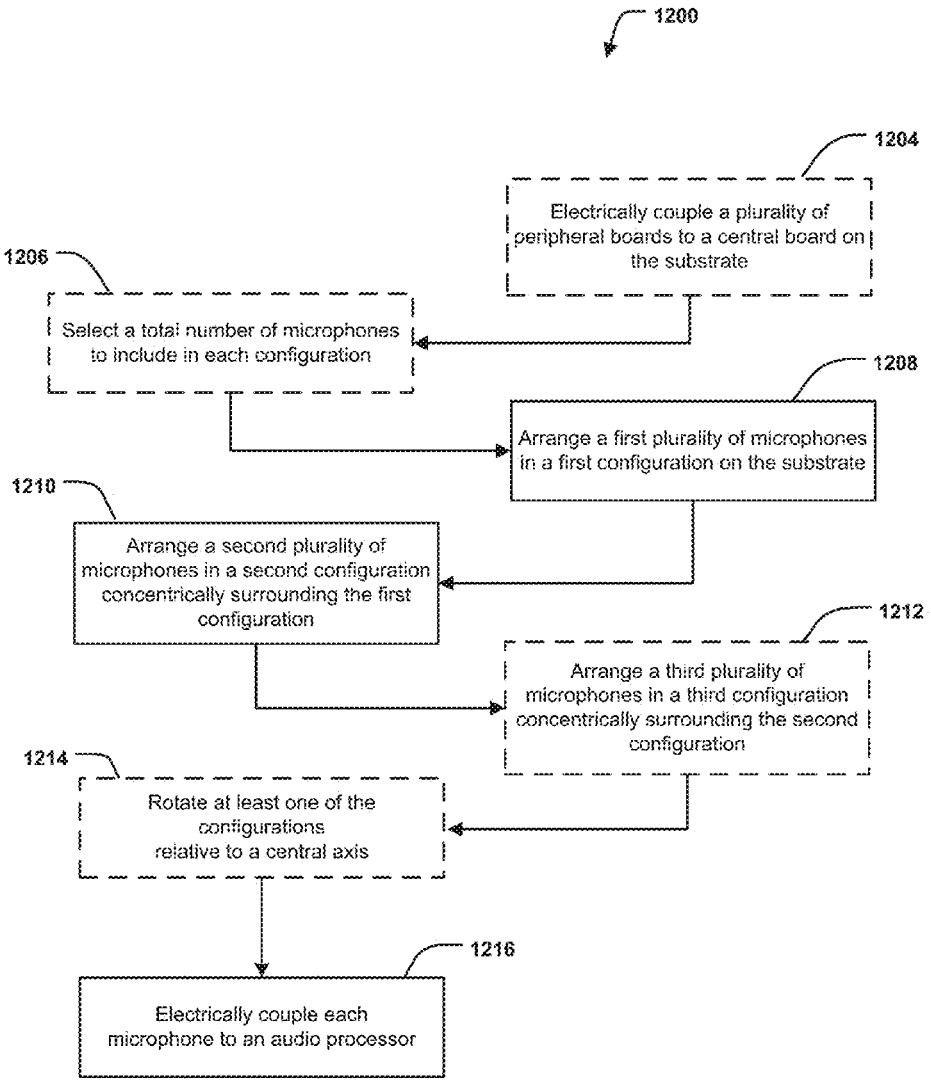
FIG. 12 is a flow diagram illustrating an example process for assembling an array microphone in accordance with certain embodiments.

FIG. 12 illustrates an example method 1200 of assembling an array microphone in accordance with embodiments. The array microphone may be substantially similar to the array microphone 104 shown in FIG. 5 and/or may include a plurality of microphones arranged in a configuration that is substantially similar to the microphone configuration 900 shown in FIG. 9. The array microphone may be arranged on a substrate, such as, for example, a printed circuit board, a carbon-fiber board, or any other suitable substrate. In some embodiments, the substrate includes a central board (e.g., the central PCB 107*a*) and a plurality of peripheral or satellite boards (e.g., the peripheral PCBs 107*b*). In such cases, the method 1200 can include step 1204, where the peripheral boards are electrically coupled to the central board, for example, using board-to-board connectors (e.g., connectors 130).

In some embodiments, the method 1200 includes, at step 1206, selecting a total number of microphones (e.g., the microphones 106*b*/906) to include in each configuration that will be placed on the substrate. Where the configuration includes a number of concentric rings, the number of microphones in each ring may be selected based on a desired frequency range of the array, a frequency band assigned to the ring, a desired microphone density for the array, as well as other considerations, as discussed herein. In one embodiment, the total number may be selected from a group consisting of numbers that are a multiple of an integer greater than one. For example, for the rings shown in FIGS. 5 and 9, the integer is seven, and each ring includes 7, 14, or 21 microphones. Other patterns or arrangements may drive the selection of the total number of microphones for each configuration, as described herein.

As illustrated, the method 1200 includes, at step 1208, arranging a first plurality of microphones in a first configuration on the substrate. The method 1200 also includes, at step 1210, arranging a second plurality of microphones in a second configuration on the substrate, the second configuration concentrically surrounding the first configuration. In some embodiments, the method 1200 can additionally include, at step 1212, arranging a third plurality of microphones in a third configuration on the substrate, the third configuration concentrically surrounding the second configuration.

In embodiments, each of the first, second, and/or third configurations comprises a number of concentric rings positioned at different radial distances from a central point of the substrate to form a nested configuration. In some cases, the first configuration includes a different number of concentric rings than at least one of the second configuration and the third configuration. For example, in the illustrated embodiment of FIG. 9, the first configuration comprises at least the innermost ring 910, the second ring 912, and third ring 914, the second configuration comprises at least the fourth ring 916 and the fifth ring 918, and the third configuration comprises at least the sixth ring 920 and the outermost ring 922. In each of the configurations, arranging the microphones can include, for each concentric ring, arranging a subset of the microphones at predetermined intervals along a circumference of that ring. In some embodiments, the first configuration further includes the central point of the substrate, and at least one of the first plurality of microphones is positioned at the central point. Further, in some embodiments, at least one of the rings included in the second configuration may be positioned on the peripheral boards. Further, in some embodiments, the third configuration may be positioned entirely on the peripheral boards.

In some embodiments, the method 1200 can include, at step 1214, rotating at least one of the first, second, and third fourth configurations relative to a central axis (e.g., the central axis 930) of the array microphone so that the configurations are at least slightly rotationally offset from each other, to improve the overall directivity of the array microphone. The method 1200 can also include, at step 1216, electrically coupling each of the microphones to an audio processor for processing audio signals captured by the microphones.

In embodiments, the first, second, and/or third pluralities of microphones are configured to cover different preset frequency ranges, or in some cases, octaves within an overall operating range of the array microphone (for example and without limitation, 100 Hz to 10 KHz). According to embodiments, a diameter of each concentric ring can be defined by a lowest operating frequency assigned to the microphones forming the ring. In some cases, the concentric rings included in the first, second, and/or third configurations are harmonically nested. In a preferred embodiment, the microphone array includes a plurality of MEMS microphones.

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. An array microphone system comprising:

a substrate; and a plurality of microphones arranged, on the substrate, in a number of concentric, nested rings of varying sizes, each ring comprising a subset of the plurality of microphones positioned at predetermined intervals along a circumference of the ring.

2. The array microphone system of claim 1, wherein the concentric, nested rings are rotationally offset from each other.

3. The array microphone system of claim 1, wherein the rings are positioned at different radial distances from a central point of the substrate to form a nested configuration.

4. The array microphone system of claim 1, wherein the plurality of microphones are micro-electrical mechanical system (MEMS) microphones.

5. The array microphone system of claim 1, wherein each of the rings forms a circle with a different diameter.

6. The array microphone system of claim 5, wherein the diameter of each ring is determined based on a lowest operating frequency assigned to the subset of microphones included in the ring.

7. The array microphone system of claim 1, wherein the number of concentric, nested rings is seven.

8. The array microphone system of claim 1, wherein the concentric rings of microphones are harmonically nested.

9. The array microphone system of claim 1, wherein the plurality of microphones includes at least 113 microphones.

10. The array microphone system of claim 9, wherein the plurality of microphones includes up to 120 microphones.

11. The array microphone system of claim 1, wherein the rings of microphones are configured to cover a preset range of audio frequencies.

12. The array microphone system of claim 1, wherein each ring comprises a predetermined number of microphones, the predetermined number being selected from a group consisting of numbers that are multiples of an integer greater than one.

13. The array microphone system of claim 1, further comprising a processor electrically coupled to the substrate and configured to receive audio signals captured by each of the plurality of microphones and to generate an output based on the received signals.

14. The array microphone system of claim 13, wherein the processor is configured to simultaneously generate multiple audio outputs based on the received audio signals.

15. The array microphone system of claim 1, further comprising an external indicator coupled to the substrate and configured to indicate an operating mode of the array microphone system.

16. The array microphone system of claim 1, wherein the substrate comprises a central printed circuit board (PCB) and a plurality of peripheral printed circuit boards (PCBs) radially positioned around, and electrically connected to, the central PCB, at least one of the number of concentric, nested rings being positioned on the plurality of peripheral PCBs.

17. A microphone assembly comprising:

an array microphone comprising a plurality of microphones; and a housing configured to support the array microphone, the housing being sized and shaped to be mountable in a drop ceiling in place of at least one of a plurality of ceiling tiles included in the drop ceiling, wherein a front face of the housing includes a sound-permeable screen having a size and shape that is substantially similar to the at least one of the plurality of ceiling tiles.

18. The microphone assembly of claim 17, wherein the housing comprises a second face positioned opposite the first face, the second face being positioned inside the drop ceiling when the housing is mounted to the drop ceiling.

19. The microphone assembly of claim 18, further comprising:

a control box coupled to the second face of the housing and configured to house a processor coupled to the array microphone; and an external port coupled to the control box and electrically connected to the processor.

20. The microphone assembly of claim 19, wherein the external port is electrically connectable to a cable configured for at least one of outputting audio signals received at the processor from the array microphone, receiving control signals from an external control system, and providing power to the processor and array microphone from an external power supply.

21. The microphone assembly of claim 17, wherein the housing is made of lightweight aluminum.

22. The microphone assembly of claim 21, wherein the housing includes an aluminum back panel comprising a honeycomb core.

23. The microphone assembly of claim 17, wherein the housing is substantially square-shaped.

24. The microphone assembly of claim 17, wherein a length and width dimensions of the housing are substantially equivalent to a cell size of a grid forming the drop ceiling.

25. The microphone assembly of claim 24, wherein the cell size is about two feet wide and about two feet long.

26. The microphone assembly of claim 17, wherein the housing is sized and shaped to replace more than one of the plurality of ceiling tiles.

27. The microphone assembly of claim 17, further comprising an external indicator coupled to the housing and configured to indicate an operating mode of the array microphone.

28. A method of assembling an array microphone, comprising:

arranging a first plurality of microphones to form a first configuration on a substrate;

arranging a second plurality of microphones to form a second configuration on the substrate, the second configuration concentrically surrounding the first configuration; and electrically coupling each of the first and second pluralities of microphones to an audio processor for processing audio signals captured by the microphones.

29. The method of claim 28, wherein the first and second pluralities of microphones are configured to cover different preset frequency ranges.

30. The method of claim 28, wherein each of the first and second configurations comprises a number of concentric rings positioned at different radial distances from a central point of the substrate to form a nested configuration.

31. The method of claim 30, wherein arranging the first plurality of microphones includes for each of the number of concentric rings, arranging a subset of the first plurality of microphones at predetermined intervals along a circumference of the ring.

32. The method of claim 30, wherein the first configuration further comprises the central point of the substrate, and arranging the first plurality of microphones includes arranging at least one of the first plurality of microphones at the central point.

33. The method of claim 30, wherein the first configuration includes a different number of concentric rings than the second configuration.

34. The method of claim 30, wherein a diameter of each concentric ring is defined by a lowest operating frequency assigned to the microphones forming the ring.

35. The method of claim 30, wherein the substrate comprises a central board and a plurality of peripheral boards radially coupled to the central board, and at least one of the concentric rings in the second configuration is included on the plurality of peripheral boards, the method further comprising electrically coupling the plurality of peripheral boards to the central board.

36. The method of claim 30, wherein the concentric rings in each of the first and second configurations are harmonically nested.

37. The method of claim 28, further comprising:

arranging a third plurality of microphones in a third configuration on the substrate, the third configuration concentrically surrounding the second configuration; and electrically coupling the third plurality of microphones to the audio processor.

38. The method of claim 28, further comprising rotating at least one of the first and second configurations relative to a central axis of the array microphone.

39. The method of claim 28, wherein the microphones are micro-electrical mechanical system (MEMS) microphones.

40. The method of claim 28, further comprising: selecting a total number of microphones to include in each of the first and second configurations.

* * * * *